US006173712B1

(12) United States Patent
Brunson

(10) Patent No.: US 6,173,712 B1
(45) Date of Patent: Jan. 16, 2001

(54) DISPOSABLE AEROSOL MASK WITH DISPARATE PORTIONS

(75) Inventor: Kevin K. Brunson, Argyle, TX (US)

(73) Assignee: Kimberly-Clark Worldwide, Inc., Neenah, WI (US)

( * ) Notice: Under 35 U.S.C. 154(b), the term of this patent shall be extended for 0 days.

(21) Appl. No.: 09/069,359

(22) Filed: Apr. 29, 1998

(51) Int. Cl.[7] ..... A62B 18/02
(52) U.S. Cl. ..... 128/206.19; 128/201.17
(58) Field of Search ..... 128/206.19, 201.29, 128/201.25, 201.17, 863; 2/424

(56) References Cited

U.S. PATENT DOCUMENTS

| | | |
|---|---|---|
| 1,292,095 | 1/1919 | Schwartz . |
| 2,012,505 | 8/1935 | Goldsmith . |
| 2,227,667 | 1/1941 | Panettiere . |
| 2,556,589 | 6/1951 | Le Duc . |
| 3,049,121 | 8/1962 | Brumfield et al. . |
| 3,688,768 | 9/1972 | Reimschussel et al. . |
| 3,888,246 | 6/1975 | Lauer . |
| 4,323,063 | 4/1982 | Fisichella . |
| 4,384,577 | 5/1983 | Huber et al. . |
| 4,454,881 | 6/1984 | Huber et al. . |
| 4,600,002 | 7/1986 | Maryyanek et al. . |
| 4,628,927 | 12/1986 | Ward . |
| 4,635,628 | 1/1987 | Hubbard et al. . |
| 4,688,566 | 8/1987 | Boyce . |
| 4,856,509 | 8/1989 | Lemelson . |
| 4,873,972 | 10/1989 | Magidson . |
| 5,003,633 | 4/1991 | Itoh . |
| 5,062,421 | 11/1991 | Burns et al. . |
| 5,094,236 | 3/1992 | Tayebi . |
| 5,322,061 | 6/1994 | Brunson . |
| 5,419,318 | 5/1995 | Tayebi . |
| 5,435,300 | 7/1995 | Brunson . |
| 5,561,863 | 10/1996 | Carlson, II . |
| 5,596,985 | 1/1997 | Collier . |
| 5,699,791 | 12/1997 | Sukiennik et al. . |
| 5,803,075 | 9/1998 | Yavitz . |

FOREIGN PATENT DOCUMENTS

| | | |
|---|---|---|
| 655814 | 1/1938 | (DE) . |
| 0515986 A1 | 12/1992 | (EP) . |
| 0752214 A1 | 1/1997 | (EP) . |
| 892262 | 3/1962 | (GB) . |
| 2028664 | 3/1980 | (GB) . |
| 9707696 | 3/1997 | (WO) . |

*Primary Examiner*—Michael A. Brown
*Assistant Examiner*—Labta M. Hamilton
(74) *Attorney, Agent, or Firm*—Dority & Manning

(57) ABSTRACT

A disposable mask is provided having a body with an opening sized to cover the nose and mouth of a wearer and a fastening system to secure the body to the wearer's face. The body has top and bottom edges with the top edge operable to extend across the nose and cheeks of the wearer and the bottom edge to extend below the mouth of the wearer. The body includes a first portion which generally contacts the face of the wearer and is formed from a material that is shapeable around the face of the wearer. A second portion is attached to and extends from the shapeable material and is formed from a disparate material that filters aerosol particles from the air that passes through it.

16 Claims, 6 Drawing Sheets

DISPOSABLE AEROSOL MASK WITH DISPARATE PORTIONS

BACKGROUND OF THE INVENTION

This invention relates generally to face masks capable of preventing passage of airborne aerosol particles, and more particularly to a disposable face mask comprising two disparate portions of material and a method of manufacturing the same.

Disposable masks have been manufactured for many years. In the medical field, most of these masks have been for use in preventing contamination of a patient by the breath of health care personnel. In recent years with increased concern for infection of health care personnel with airborne pathogens, particularly such as the hepatitis B virus and multi-drug resistant tuberculosis, it has become necessary to prevent not only the contamination of patients due to exhalation from health care personnel, but also to prevent infection of health care personnel due to inhalation of airborne infection particles. It has become even more important in view of the advent of human immunodeficiency virus (HIV) and the recent increase in infectious tuberculosis associated with many HIV patients.

In addition, it has been found that aerosols having airborne liquid and solid particles are generated not only by the exhalation of infected patients, but also by certain procedural manipulations and processes that impart energy to any microbial suspension. Surgical procedures involving use of drills and saws are particularly prolific producers of the aerosols which may contain tuberculosis, HIV or other pathogens from an infected patient. Concern with tuberculosis has been increasing since new strains of the disease show strong resistance to multiple types of drug treatment.

In addition, it has been shown that many of the viral hemorrhagic fevers such as yellow fever, Rift Valley fever and perhaps Rocky Mountain spotted fever, rabies and smallpox can be transmitted through aerosols. A considerable number of studies have been made which are now beginning to identify the transmission of such viruses through "non-accident" situations. Accordingly, it is now believed that many of the those non-accident situations result from aerosol contamination.

Of the current medical masks on the market, it appears that many are not effective against aerosols. For example, one of the presently available molded-type surgical masks has almost no resistance to particles smaller than two (2) microns and has a low efficiency in blocking particles as large as nine (9) microns. Some masks apparently demonstrate somewhat better qualities, but none appear to be fully satisfactory in preventing the passage of aerosols through the mask or around the periphery of the mask.

Accordingly, it can be seen that a need exists for a mask which will minimize the passage of aerosols both through and around the mask, while maintaining the comfort of the wearer.

SUMMARY OF THE INVENTION

The present invention recognizes and addresses the foregoing disadvantages, and others, of prior art construction and methods.

Accordingly, it is an object of the present invention to provide an improved design for a disposable face mask to prevent bypass of aerosols between the edges of the mask and the face of the wearer. More particularly, it is an object of the present invention to provide a disposable mask with two distinct portions formed from disparate materials selected to optimize performance based on the placement of the portions.

Additional objects and advantages of the invention will be set forth in part in the following description, or may be obvious from the description, or may be learned through practice of the invention.

In accordance with the objects and purposes of the present invention, a disposable mask is provided for protecting the face of a wearer. The mask has an opening sized to cover the nose and mouth of the wearer, and a sealed end opposite the opening. The opening may be defined by a top edge extending over the nose and cheeks of the wearer, a bottom edge extending below the mouth of the wearer, and two opposite sides. The body of the mask comprises a first portion adjacent the edges of the opening that is formed from a material shapeable around the face of the wearer. The body of the mask also comprises a second portion coupled with the first portion and extending to the sealed end. This second portion is formed from a filter material which is thus concentrated in the end or center of the mask.

The mask may be configured as any number of conventional masks. For example, in one particular embodiment, the mask may be formed from two generally trapezoidal panels sealed along three edges, with each other edges forming the opening of the mask. In another embodiment, the mask may be formed as a generally rectangular mask with a number of lateral pleats formed therein to allow the mask to conform to the nose and mouth of the wearer. The pleats may extend across the second material forming the filter portion of the mask, or may be eliminated from the second portion depending on the configuration of the filter material. Alternatively, the mask may be formed as a traditional molded cup or cone-shaped mask. Various configurations and shapes of masks are well known to those skilled in the art and any and all such conventional masks are within the scope and spirit of the present invention.

The first portion of the mask formed from shapeable material may comprise a single layer of material, multiple layers of material, and multiple combinations of different materials. In one embodiment, multiple layers of material are bonded together to form the material of the first portion, with one layer of material extending to be coupled with the second portion. Similarly, the second portion may also be formed from multiple layers of material bonded together with a layer extending for attachment to the first portion. Bonding may be accomplished through any conventional method, such as sewing, heat bonding, ultrasonic bonding, or the like. The second portion of the mask consists of filter media and may comprise a single layer of material, multiple layers of material, and multiple combination of different material.

The mask also includes devices for attaching to the face of the wearer. Any manner of conventional attaching devices are within the scope and spirit of the invention. For example, the mask may include at least one strap for securing about the wearer's head. Alternatively, the mask may include straps extending from the top and bottom edges thereof for being tied around the wearer's head. In an alternative embodiment, the mask may include loops for being fitted over the ears of a wearer. A vast number of attaching devices are well known to those skilled in the art and any manner of such device may be incorporated in the present invention. It should be appreciated that a number of configurations and alternative embodiments may be employed in the present invention, and that the invention is not limited to any particular type of mask, material, bonding method, or attachment method to the face of the wearer.

The present invention also encompasses a method of manufacturing a mask formed from disparate materials. The method comprises bonding one strip of shapeable material to each side of an intermediate strip of filter material, forming a composite strip. Trapezoidal panels for forming the mask may then be cut from the composite strip in an alternating manner, thus reducing the amount of scrap material produced. Upper and lower panels are then placed in juxtaposition and bonded along three sides. Although this method is directed particularly at trapezoidal panel masks, similar methods of aligning the disparate materials, bonding them, and then cutting the appropriate mask shape may then be applied to other mask types, including rectangular pleated styles and cup or cone-shaped masks.

The accompanying drawings, which are incorporated in and constitute a part of this application, illustrate two embodiments of the invention and, together with the description, serve to explain the principles of the invention.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION OF THE PREFERRED EMBODIMENTS

Figure 1:
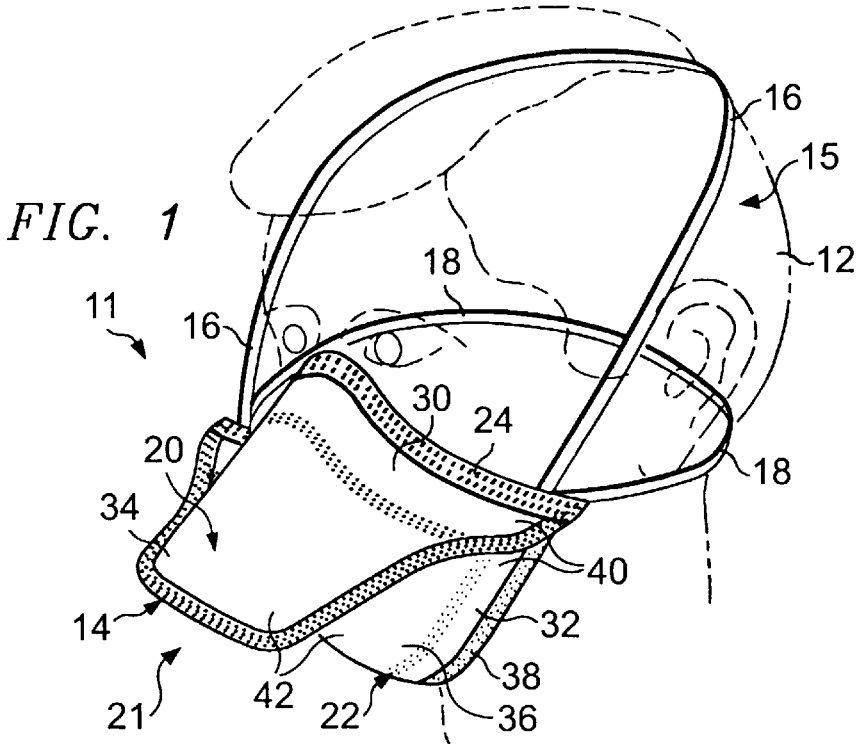
FIG. 1 is a perspective view illustrating a mask positioned on the head of a wearer in accordance with one embodiment of the present invention.

Reference will now be made in detail to the presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The present invention is concerned with a disposable mask having disparate portions of material. As described in more detail below, one material can be chosen for its shapeable qualities to help ensure a tight fit around the user's face. The other material can be chosen for its qualities for filtering aerosol particles. Accordingly, a mask can be created which ensures a tight fit with the wearer's face while still filtering aerosol particles and enabling the wearer to breath easily.

Each of FIGS. 1, 4, 8, and 9 illustrate a mask 11 disposed on the head of a wearer 12 (shown in ghost lines) and constructed in accordance with one embodiment of the present invention. A general description of exemplary embodiments of disposable masks which are preferably constructed in accordance with the present invention follows.

As shown in FIGS. 1, 4, 8, and 9, mask 11 preferably has the general shape of a cup or cone defining an opening 66 that is generally against the wearer's face when worn, and a sealed end, generally 21. The filter portion of the masks is generally disposed in the area of sealed end 21 and held off the wearer's face 12. "Off-the-face" style masks provide a breathing chamber to permit cooler wear and easier breathing. The volume of air contained within body 14 should be optimized to prevent retention of excessive amounts of exhaled air within body 14 at normal breathing rates. By properly selecting the size of body 14, excessive heating of the air within body 14 is reduced and dizziness from prolonged periods of breathing exhaled air is minimized.

In a preferred embodiment, illustrated in FIGS. 1, 2, 4, 5, and 7, body 14 may comprise an upper panel 20 and a lower panel 22 of a generally trapezoidal configuration. The upper panel 20 and the lower panel 22 may have an identical configuration and may be bonded together along three sides. In one embodiment, the sides may be bonded by heat and/or ultrasonic sealing. Bonding in this manner adds important structural integrity to mask 11.

Figure 2:
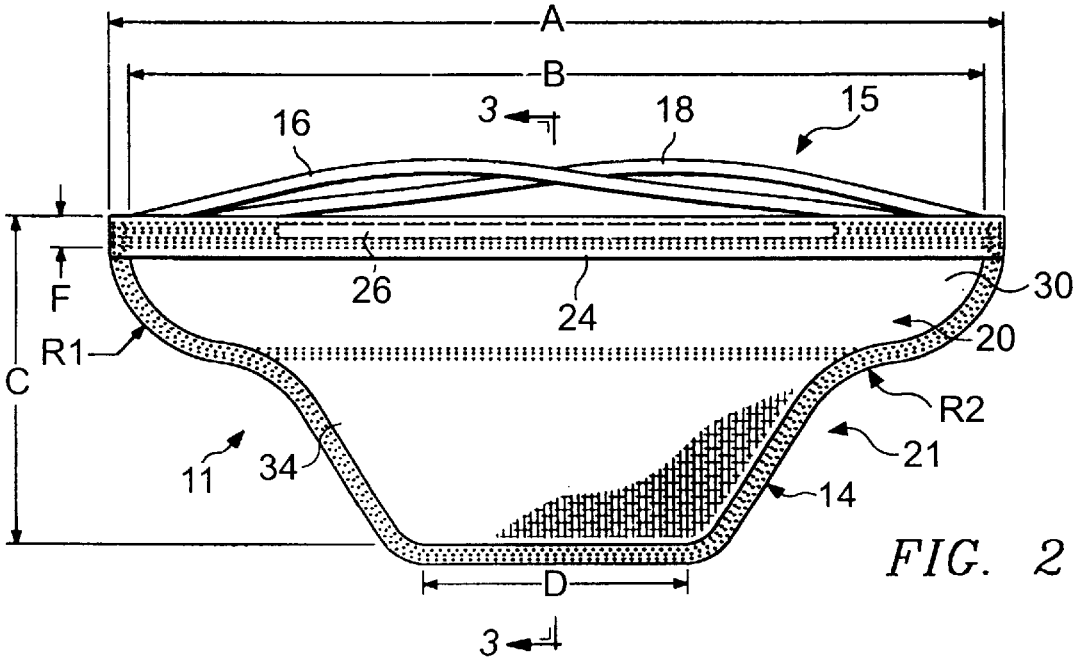
FIG. 2 is the top plan view illustrating the mask of FIG. 1.

The fourth, unbonded side of the upper panel 20 is open and includes a top edge 24. The top edge 24 is arranged to receive an elongated malleable member 26 as shown in FIGS. 2 and 3. With the exception of having malleable member 26 located along the top edge 24 of upper panel 20 of mask 11, upper and lower panels 20 and 22 may be identical. Malleable member 26 is provided so that top edge 24 of mask 11 can be configured to closely fit the contours of the nose and cheeks of wearer 12. Such a mask is described in U.S. Pat. No. 5,322,061, issued to Brunson on Jun. 21, 1994, the entire disclosure of which is hereby incorporated by reference.

In order to reduce "blow-by" associated with normal breathing of wearer 12, malleable strip 26 is preferably positioned in the center of top edge 24 and has a length in the range of 50 percent to 70 percent of the total length (A) of top edge 24, as shown in FIG. 1. Malleable member 26 is preferably constructed from an aluminum strip with a rectangular cross-section, but may also be a moldable or malleable steel or plastic member. In one embodiment of the present invention, the performance of mask 11 was enhanced by using malleable strip 26 manufactured from quarter-tempered aluminum.

The fourth, unbonded side of the lower panel 22 may include a bottom edge 38. Top edge 24 of the upper panel 20 and bottom edge 38 of lower panel 22 cooperate with each other to define the periphery or opening 66 of body 14 which contacts the face of wearer 12, helping to optimize the barrier formed between the periphery of body 14 and the face of wearer.

Optimum relative dimensions for mask 11 are illustrated in FIG. 2. The precise dimensions may be modified to accommodate wearers having particularly small or large facial features. However, the ratio between the width© and the minor length (D) of the trapezoid portion of mask 11 should preferably remain approximately 1 to 1. In this embodiment, the preferred ratio between the major length of body 14 (A) and the minor length (D) is approximately 3 to 1.

In the embodiment of the present invention illustrated in FIG. 2, radius R1 and R2 are formed in the non-parallel or angled sides of body 14. As an example of their respective dimensions, R1 may be 1⅛" and radius R2 may be 3". Radii R1 and R2 cooperate with each other to prevent collapse of body 14 during normal breathing by wearer 12 and help mask 11 retain the desired, off-the-face shape. Radii R1 and R2 are preferably combined with a sealed border of not less than ¼" in width to provide the desired shape covering the nose and mouth of wearer 12 and to maintain a tight fit with the face of wearer 12 without collapsing during normal breathing.

Figure 7:
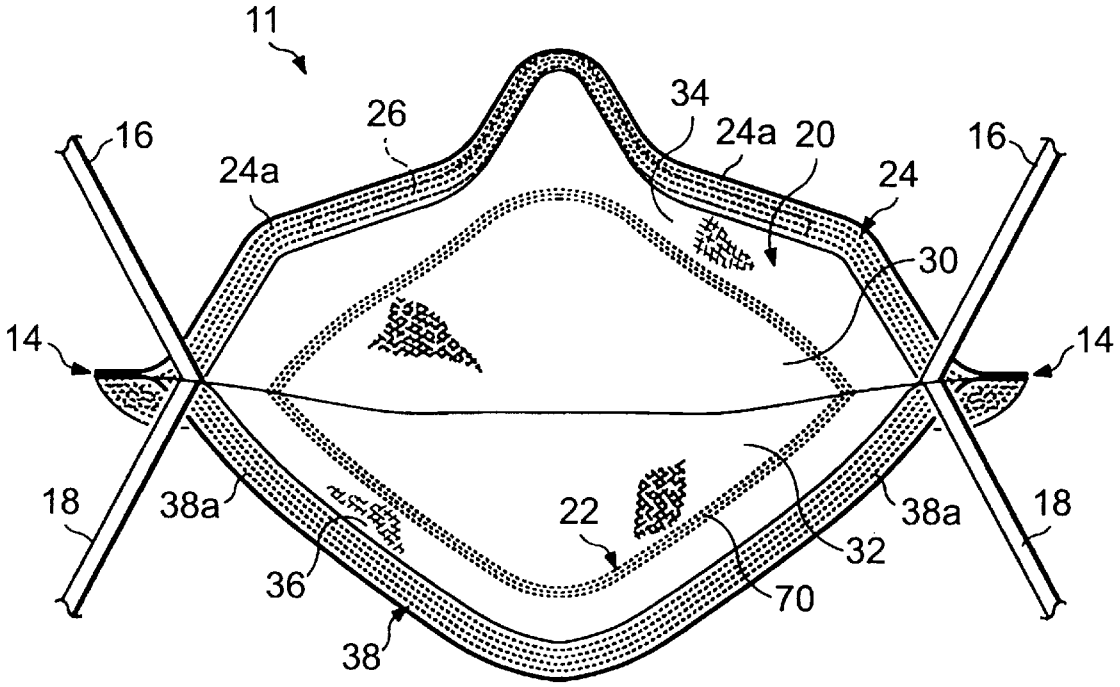
FIG. 7 is an isometric diagram illustrating interior portions and edges of the mask of FIG. 1 in accordance with one embodiment of the present invention.

More particularly, radius R2 curves outward from opposite sides of mask 11 and is tangent to radius R1 that curves inward towards the attachment points for securing members 16 and 18. Radii R1 and R2 cooperate with each other to improve the facial seal performance between the periphery of mask 11 and wearer's face 12. Also, as shown in FIG. 7, radii R1 and R2 allow mask 11 to open with relatively flat surfaces 24*a* and 38*a* at each end of top edge 24 and bottom edge 38 adjacent to the attachment point for securing members 16 and 18. These flat surfaces adjacent to the attachment point for the securing members 16 and 18 gradually taper away from the opening in body 14.

Radii R1 and R2 cooperate with top edge portion 24 and bottom edge portion 38 to allow mask 11 to fit securely with and to form a tight facial seal on a greater number of different face sizes. Mask 11 is particularly useful with smaller faces which contact the tapered surfaces adjacent to the attachment points for securing members 16 and 18 on the interior of mask 11 illustrated in FIG. 7. Flat surface 24*a* and 38*a* adjacent to the attachment points for securing members 16 and 18 allows mask 11 to have increased sealing area against the face of wearer 12.

In a preferred embodiment, the mask 11 comprises a body 14 that is secured to wearer 12 by means of fastening system 15. The fastening system 15 may comprise resilient and elastic straps or securing members 16 and 18. The mask 11 may be positioned over the nose and under the chin of the wearer 12.

Figure 4:
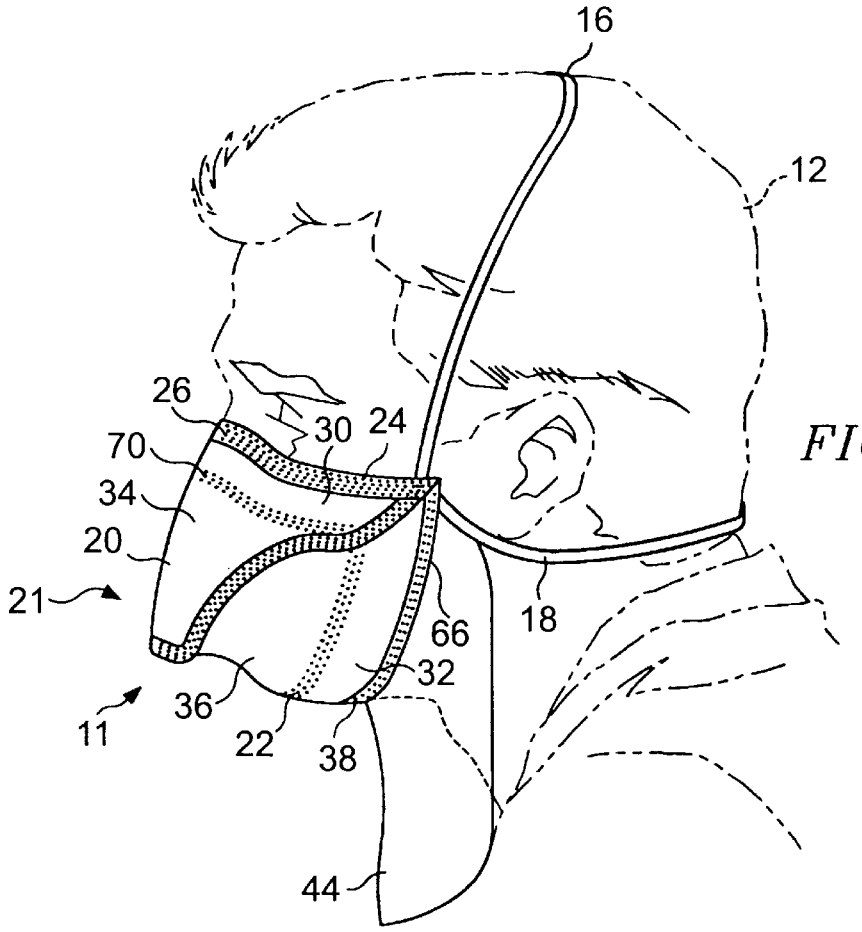
FIG. 4 is a side view illustrating the mask of FIG. 1 having a neck guard in accordance with one embodiment of the present invention.
Figure 5:
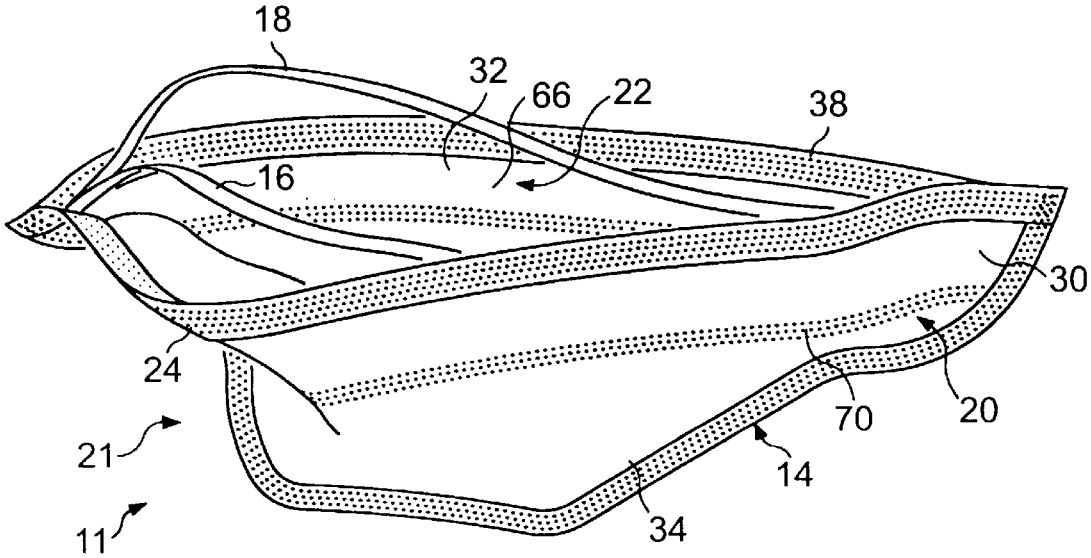
FIG. 5 is an interior view of the mask of FIG. 1 illustrating the attachment of the fastening system to the body of the mask in accordance with one embodiment of the present invention.

Referring to FIGS. 1 and 4, mask 11 is shown in position on the face of wearer 12. As seen in FIG. 1, upper half 20 with malleable member 26 located in top edge 24 conforms very closely to the configuration of the nose and cheeks of wearer 12. In FIG. 4, it can be seen that bottom edge 38 fits under the chin of wearer 12. As previously described, the first portion 40 is shapeable around the face of the wearer 12 to provide a close fit between bottom edge 38 and the chin of wearer and top edge 24 and the nose and cheeks of the wearer. This reduces or eliminates leaks that result in bypass or blow-by of air either entering mask 11 or being discharged from mask 11 as it is used by wearer 12. Such leakage around a top and bottom edge of a mask reduces its effectiveness.

In one embodiment, straps 16 and 18 may comprise resilient polyurethane. The straps 16 and 18 may also be constructed from elastic rubber or a covered stretch yarn and the like. The covered stretch yarn may consist of an elastomeric material wrapped with nylon or a polyester.

As shown in FIG. 7, in a preferred embodiment the securing members or straps 16 and 18 are attached at the junctures between top edge 24 and bottom edge 38 of mask 11 with no gap between the ends of straps 16 and 18. The position of attaching straps 16 and 18 to body 14 in cooperation with radii R1 and R2 results in the optimum pull angle to form a fluid tight barrier between surfaces 24*a* and 38*a* on the interior of mask 11 and the face of wearer 12. Strap 16 can be placed over the top of the head of wearer 12, as illustrated most clearly in FIG. 4, in alignment with bottom edge 38 of mask 20 so that a direct force is exerted along that line urging bottom edge 38 into sealing engagement with the chin of wearer 12. Similarly, strap 18 can be placed around the lower base of the skull and in direct alignment with top edge 24 of mask 11 and thus exerting a force which tends to move top edge 24 into tighter sealing engagement with the nose and cheeks of wearer 12.

Figure 8:
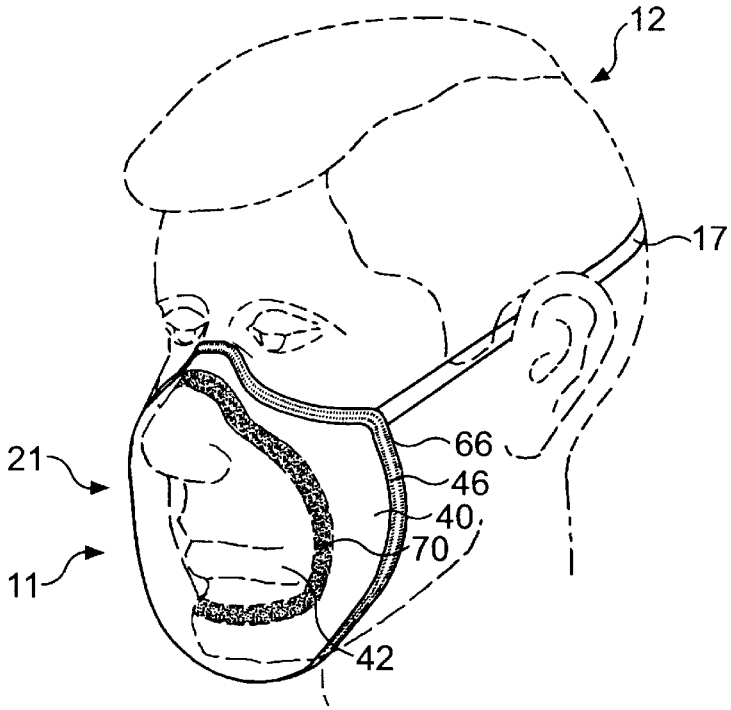
FIG. 8 is a perspective view illustrating a mask positioned on the head of a wearer in accordance with one embodiment of the present invention.

FIG. 8 illustrates an alternative embodiment of the present invention. Mask 11 is a traditional cone mask, well-known in the art. Such masks are described in U.S. Pat. No. 4,384,577, issued to Huber et al. on May 24, 1983; U.S. Pat. No. 4,454,881, issued to Huber et al. on Jun. 19, 1984; and U.S. Pat. No. 4,600,002, issued to Maryyanek et al. on Jul. 15, 1986; the entire disclosure of each being hereby incorporated by reference.

In this embodiment, cone mask 11 is defined by a border 46 defining the opening 66 of the mask and molded to fit snugly around the nose, cheeks, and chin of wearer 12. The top edge of the border 46 may be formed from a malleable strip similar to that discussed above which may be independently conformed about the nose of the wearer 12. Attaching strap 17 works in conjunction with border 46 to ensure a close fit and minimize the passage of aerosols around the edge mask 11.

Figure 9:
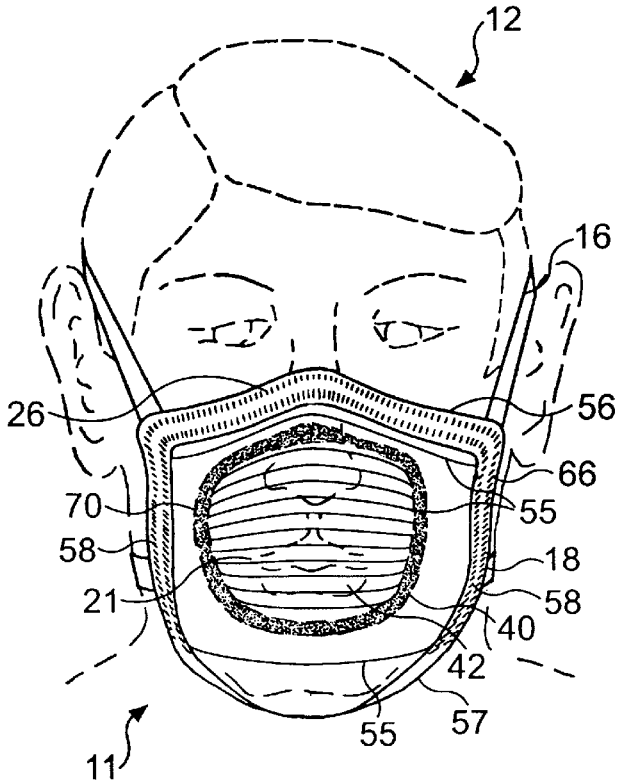
FIG. 9 is a perspective view illustrating a mask positioned on the head of a wearer in accordance with one embodiment of the present invention.

In an alternative embodiment illustrated in FIG. 9, mask 11 is formed with lateral pleats 55 and a malleable strip 26 parallel to and in the vicinity of pleats 55. Top edge 56, bottom edge 57, and side edges 58 cooperate with each other to define the periphery of mask 11 that contacts the face of the wearer 12.

Lateral pleats 55 allow expansion of mask 11 to cover the mouth and nose of a wearer 12. The number, size, and orientation of pleats 55 formed in mask 11 may be varied to provide the desired fit with the face of wearer 12 and to conform to the specific environment in which the mask is to be used. The operation of pleats 55 causes malleable strip 26 to open outwardly and support mask 11 away from the nose and mouth of the wearer, thereby providing greater filtering efficiency and wearer comfort. Such a mask is described in U.S. Pat. No. 4,635,628, issued to Hubbard et al. on Jan. 13, 1987, the entire disclosure of which is hereby incorporated by reference.

In a preferred embodiment, the body 14 of mask 11 includes a first inner portion 40 and a second portion 42 of disparate materials. The first inner portion 40 comprises a material that is shapeable around the face of the wearer 12. The purpose of the inner portion 40 is to ensure a tight fit with the wearer's face in order to minimize passage of air between the periphery of the mask and the wearer's face. The outer portion 42 comprises a breathable filter media that permits the flow of gases in both directions. The purpose of the outer portion 42 is to filter aerosols from the air that the wearer 12 is inhaling. In each of the FIGS. 1–9, the seal 70 between the inner 40 and outer 42 portions of mask 11 is indicated by a shaded outline.

Figure 3A:
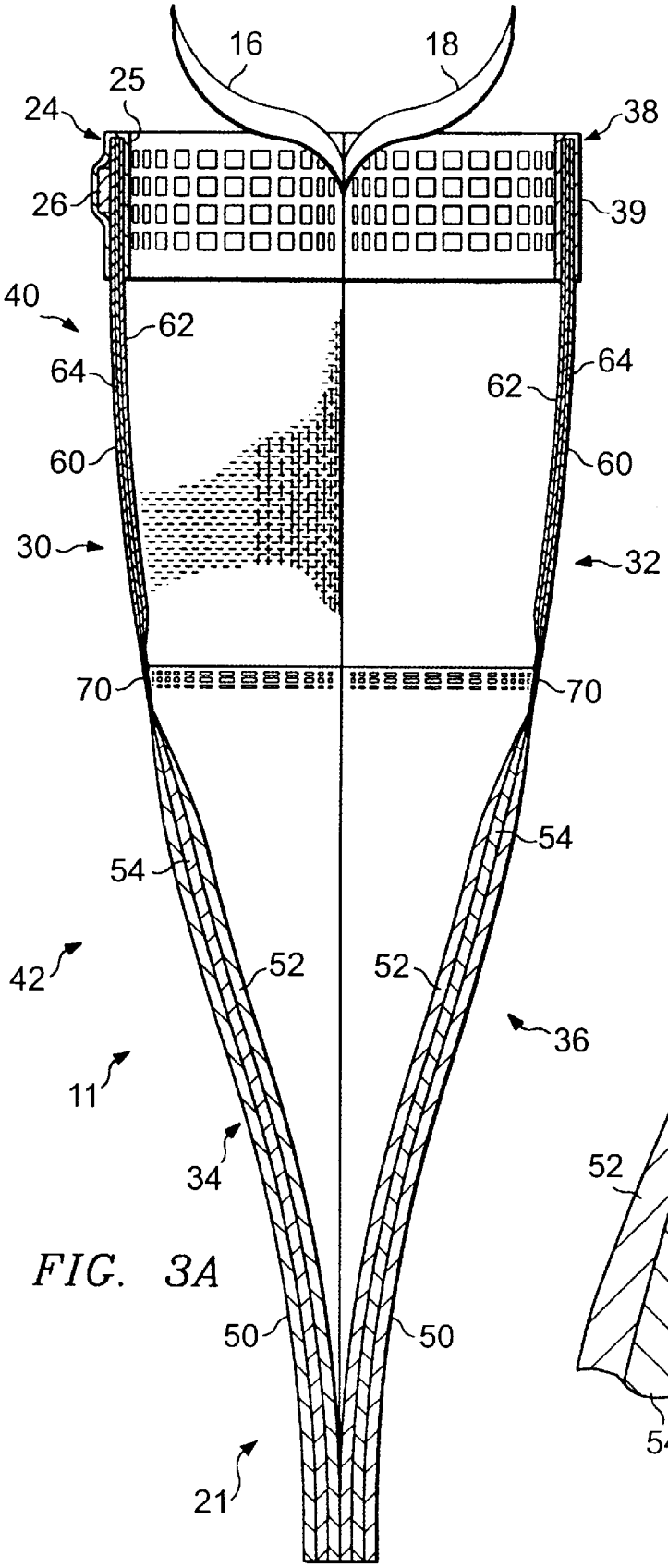
FIG. 3A is a cross-sectional diagram, taken generally along the line 3—3 of FIG. 2, illustrating the first and second portions of the mask of FIG. 1 in accordance with one embodiment of the present invention.

FIG. 3A details the layers of disparate material incorporated in one embodiment of the present invention, using the trapezoidal paneled mask. Mask 11 includes an inner portion 40 worn closest to the face including an upper inner portion 30 and a lower inner portion 32. In this embodiment, the outer portion 42, the remaining portion of mask 11, includes an upper outer portion 34 and a lower outer portion 36. In one embodiment, the upper portions 30 and 34 may be attached to each other at one edge to form the upper panel 20 of mask 11 which has a generally trapezoidal configuration. The upper portions 30 and 34 may be otherwise coupled to one another within the scope of the present invention. In a particular embodiment, the upper inner and outer portions 30 and 34 may be bonded together by heat or ultrasonic bonding.

The lower inner portion 32 and the lower outer portion 36 may also be coupled to each other. In one embodiment, the lower portions 32 and 36 may be attached at one edge to form the lower panel 22 of mask 11 also having generally trapezoidal configuration. The lower portions 32 and 36 may be otherwise coupled to one another within the scope of the present invention. In a particular embodiment, the lower inner and outer portions 32 and 36 may be bonded together by heat or ultrasonic bonding.

Figure 3B:
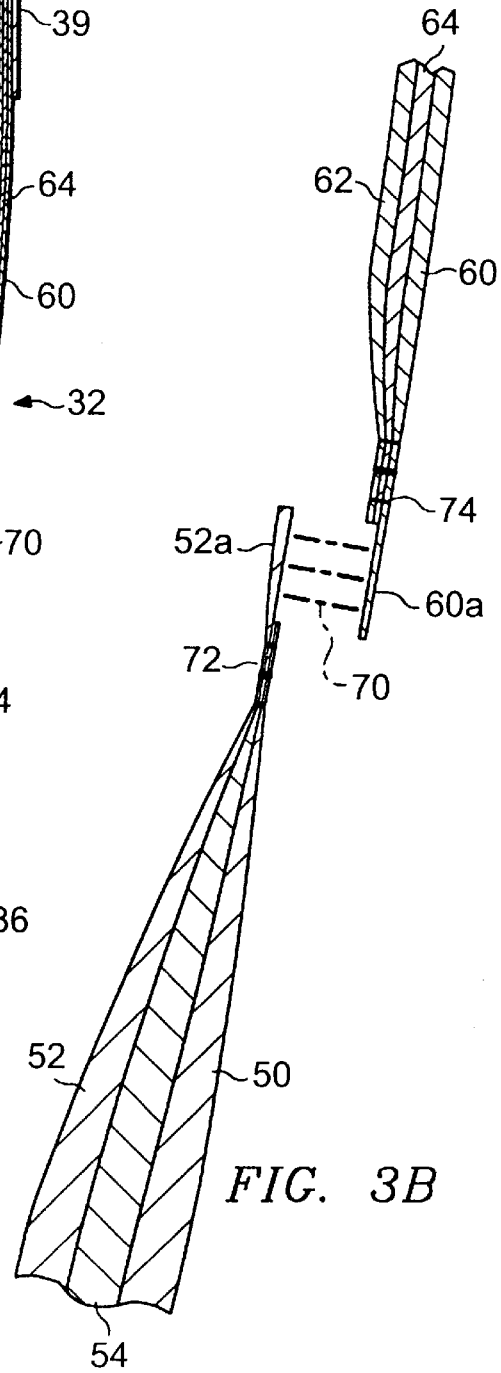
FIG. 3B is an enlarged cross-sectional diagram illustrating an exploded view of the connection between the first and second portions of FIG. 3A in accordance with one embodiment of the present invention.

As illustrated in FIGS. 3A and 3B, in one embodiment the inner and outer portions 40 and 42 are each preferably constructed of three layers of material. In accordance with the present invention, the portions 40 and 42 may be comprised of disparate materials in that at least one layer of one portion comprises a material absent from the other portion. In one embodiment, the outer portion 42 includes an exterior breathable layer 50, an intermediate breathable layer 54, and an interior breathable layer 52.

The exterior breathable layer 50 may be constructed from a spun-bonded polypropylene. The exterior breathable layer 50 may also be constructed from a bi-component and/or powder bonded material such as polyethylene or polypropylene, a cellulastic tissue, or a spun-bonded polyester. Exterior breathable layer 50 typically has a basis weight range of 0.5 ounces per yard to 1.0 ounces per yard. In a particular embodiment, 0.9 ounces per yard is the preferred basis weight for exterior breathable layer 50.

The interior breathable layer 52 may comprise a bicomponent polyethylene and polypropylene. The interior breathable layer 52 may also be constructed from polyester and/or polyethylene material or cellulastic tissue. Interior breathable layer 52 typically has a basis weight range of 0.4 ounce per yard to 0.75 ounces per yard. In a particular embodiment, 0.413 ounces per yard is one of the preferred basis weights for layer 52.

Located between exterior breathable layer 50 and interior breathable layer 52 is the intermediate breathable layer 54. The intermediate breathable layer 54 provides the filter media for mask 11. In one embodiment, the intermediate breathable layer 54 may be constructed from a melt-blown polypropylene, extruded polycarbonate, melt-blown polyester, melt-blown urethane or the like. Further information regarding the filter media is disclosed by U.S. Pat. No. 5,322,061 which is hereby incorporated by reference. It will be understood that the material of each layer 50, 52, and 54 may be varied within the scope of the present invention.

In one embodiment, the inner portion 40 may comprise an exterior shapeable layer 60, an interior shapeable layer 62, and an intermediate shapeable layer 64.

In one embodiment, the exterior shapeable layer 60 may be constructed from plastic film or nonwoven material. Exterior shapeable layer 60 may also be constructed from foam. Exterior shapeable layer 60 typically have a basis weight range of 0.5 ounces per yard to 3.0 ounces per yard. In a particular embodiment, 1.0 ounces per yard may be one of the preferred basis weights for outer shapeable layers 60.

Interior shapeable layer 62 is preferably composed of a nonwoven material. Interior shapeable layer 62 may also be constructed from foam. Interior shapeable layer 62 typically has a basis weight range of 0.4 ounce per yard to 1.5 ounces per yard. In a particular embodiment, 0.5 ounces per yard may be one of the preferred basis weights for layers 62.

Located between exterior shapeable layer 60 and interior shapeable layer 62 is an intermediate shapeable layer 64. The intermediate shapeable layer 64 may be constructed from nonwovens, films, foams, and the like. Intermediate shapeable layer 64 typically has a basis weight range of 0.5 ounce per yard to 3.0 ounces per yard. It will be understood that each layer 60, 62 and 64 may be formed from other materials within the scope of the present invention.

FIG. 3B shows an exploded view of the connection between the inner portion 40 and the outer portion 42 of the body 14 in accordance with one embodiment of the present invention. The outer, inner, and intermediate breathable layers 50, 52, and 54 are preferably attached at bond 72 using heat and/or pressure. The inner breathable layer 52 may extend beyond the bond 72 to form an attachment flange 52*a*. In a similar fashion, the outer, inner, and intermediate shapeable layers 60, 62, 64 are attached at bond 74 using heat and/or pressure. The outer shapeable layer 60 may extend beyond the bond 74 to form an attachment flange 60*a*. In a particular embodiment, the attachment flanges may each be non-porous film. The attachment flanges 52*a* and 60*a* are placed in juxtaposition and attached at bond 70 using heat and/or pressure. It will be understood that the breathable and shapeable layers may be otherwise attached together and to each other within the scope of the present invention.

Depending upon the environment in which the finished mask 11 will be used, intermediate breathable layer 54 of outer portion 42 may not be required. Exterior layer 50 and interior layer 52 may provide the desired amount of filtration without including one or more intermediate layers. Similarly, inner portion 40 may only require one or two layers of material.

As shown in FIG. 3A, top edge 24 of mask 11 may be faced with an edge binder 25 that extends across the open end of mask 11 and covers malleable strip 26. Similarly, lower half 22 of mask 11 forms a bottom edge 38 that is encompassed in an edge binder 39. In one embodiment, edge binders 25 and 39 may be constructed from a spun-laced polyester material. The binders may also be constructed from a number of thermally bonded bicomponent materials, polypropylene polyethylene non-porous plastic films and the like.

FIG. 4 illustrates an alternate embodiment of mask 11 with the addition of gap guard 44. As already discussed, mask 11 includes an upper inner portion 30, a lower inner portion 32, an upper outer portion 34, and a lower outer portion 36. Mask 11 includes a first portion of a first material that closely conforms to the contours of the wearer's face to prevent the passage of gas and liquids around the periphery of the mask 11 and a second portion of a second disparate material that filters out most aerosol particles in the air being inhaled by the wearer. The upper inner portion 30 terminates at top edge which is bound as previously described. However, the bottom edge 38 is constructed slightly differently.

Instead of terminating inner shapeable layer 62 of the lower inner portion 32 at bottom edge 38, the material forming layer 62 may be extended past the bottom edge 38 to form a veil or gap guard 44 that extends downwardly from mask 11 covering a portion of the wearer's neck. During the manufacturing process, lower edge 38 is bound by an edge binding prior to the application of inner breathable layer 52 so that inner breathable layer 52 is not caught up in the binding but is adhered to bottom edge 38 by ultrasonic welding or the like.

The purpose of the veil or gap guard 44 is to extend down over a beard of wearer 12 or to extend over the neck in those cases when wearer 12 dons a hood (not shown) to complete the coverage of wearer's head 12. Veil or guard 44 prevents hair contamination from beards and skin particles which may be rubbed off by the hood from entering the working environment. Also, guard 44 will protect wearer's neck from undesired contact with aerosols and body fluids.

Figures 6A, 6B:
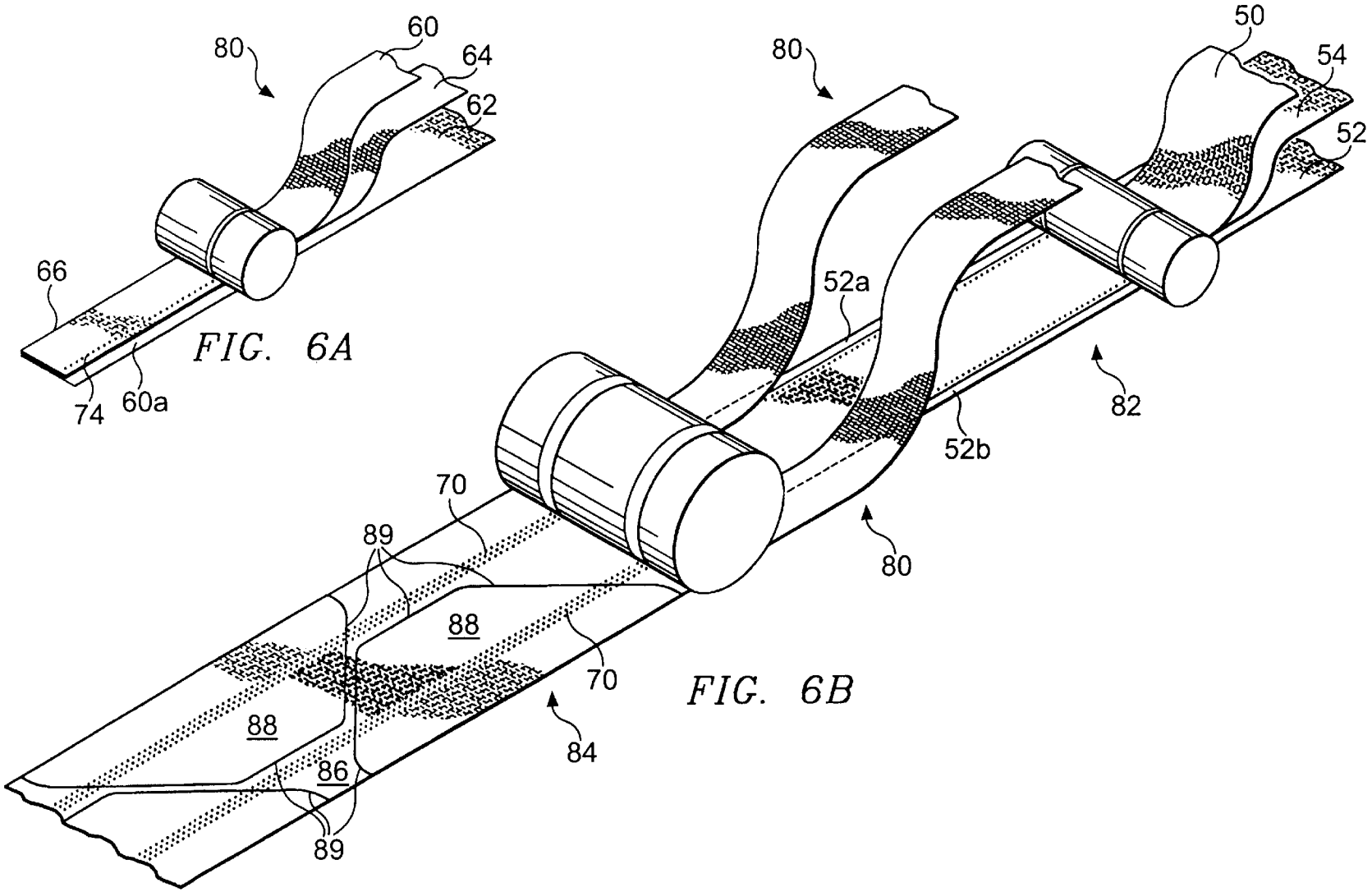
FIG. 6A is a perspective diagram illustrating the fabrication of a first portion strip of the mask of FIG. 1 in accordance with one embodiment of the present invention.
FIG. 6B is a perspective diagram illustrating fabrication and cutting of a composite strip to form upper and lower halves of the mask of FIG. 1 in accordance with one embodiment of the present invention.

FIGS. 6A and 6B illustrate another aspect of the invention, namely the fabrication of the strips of material for manufacturing the mask 11 in accordance with one embodiment of the present invention. FIG. 6A shows the fabrication of a first portion strip 80, used to make the inner portion 40 of the body 14. In one embodiment, the first portion strip 80 may be fabricated by placing a sheet of the material comprising the outer shapeable layer 60 in juxtaposition with a sheet of the material comprising the intermediate shapeable layer 64 and a sheet of the material comprising the inner shapeable layer 62. As previously described, the sheet of material comprising the outer shapeable layer 60 may be slightly wider than the other two layers 62 and 64 in order to form the attachment flange 60*a*. Preferably, the sheets are stacked so that they all share a common edge 66. After the layers 60, 62 and 64 are placed in juxtaposition, they may be bonded by heat and/or pressure along the edge adjacent the flange 60*a* to form bond 74.

FIG. 6B shows the fabrication of a second portion strip 82 as well as a composite strip 84, including both the first portion and the second portion, in accordance with one embodiment of the present invention. The second portion strip 82 may be fabricated by placing a sheet of the material comprising the outer breathable layer 50 in juxtaposition with a sheet of the material comprising the intermediate breathable layer 54 and a sheet of the material comprising the inner breathable layer 52. As previously described, the sheet of material comprising the inner breathable layer 50 may be slightly wider than the other two layers 52 and 54 in order to form the attachment flanges 52*a* and 52*b*. Preferably, the sheets are stacked so that both edges of the outer breathable layer 50 and the intermediate layer 54 are aligned, and so that these two layers 50 and 54 are centered on the sheet of material comprising the inner breathable layer 52. After the layers 50, 52 and 54 are placed in juxtaposition, they may be bonded by heat and/or pressure along the edges adjacent the flanges 52*a* and 52*b* to form bonds 72.

The composite strip 84 is preferably fabricated by placing a first portion strip 80 on each side of the second portion strip 82. Preferably, the flanges 52*a* and 52*b* of the second portion strip 82 each overlap the flange 60*a* of the adjacent first portion strip 80. The attachment flanges 52*a* and 52*b* may then be bonded together with the respective attachment flange 60*a* to form bond 70.

The mask outlines 88 shown on the composite strip represent the outline of cutters which ultimately cut upper and lower panels 20 and 22 of body 14 from the composite strip 84. In one embodiment, the alternating arrangement of the layouts may form a continuous piece of scrap 86 as the material is fed through the cutter (not shown) utilized in making body 14. The alternating layout, made possible by the generally trapezoidal shape of body 14, produces very little scrap with very little wasted material produced during the production of mask 11.

In another embodiment of the above fabrication, only one first portion strip 80 may be used in assembling a composite strip 84. In this embodiment, the second portion strip 80 would only need one attachment flange 52*a*. In this embodiment, the mask shapes are preferably oriented identically along the composite strip 84.

After the cutting process described above, masks 11 may be assembled using the following process with further references to FIGS. 3A and 3B. Two composite strips 84 are used, one to produce upper panels 20 and one to produce lower panels 22. Binders 25 and 39 are secured to top edge 24 and bottom edge 38 of the upper and lower panels 20, 22 as shown in FIG. 3A. The upper and lower panels 20, 22 are placed in juxtaposition, preferably aligning the identical sides. The three shorter sides 89 of upper panel 20 and lower panel 22 are connected with each other by heat sealing or ultrasonic bonding to form body 14 having a general trapezoidal shape with an open side defined by top edge 24 and bottom edge 38. Straps 16 and 18 are then attached to the corners of top edge 24 and bottom edge 38 at the junction between upper panel 20 and lower panel 22.

A similar method of manufacture could be used to incorporate the sealing of disparate materials in a pleated-style mask shown in FIG. 9. Rather than using composite strips, the mask would be formed by placing a generally rectangular frame of shapeable layers of material surrounding and adjacent to an interior filter portion formed from breathable layers of material. The mask would then be bonded as described above between the frame and the interior filter portion, as well as along the exterior periphery of the rectangular frame.

Methods of manufacture associated with the cone mask illustrated in FIG. 8 are well-known in the art and may be used with the present invention with the additional molding step described to incorporate the disparate materials.

While preferred embodiments of the present invention have been described above, it is to be understood that any and all equivalent realizations of the present invention are included within the scope and spirit thereof. Thus, the embodiments depicted are presented by way of example only and are not intended as limitations upon the present invention. While particular embodiments of the invention have been described and shown, it will be understood by those of ordinary skill in this art that the present invention is not limited thereto since many modifications can be made. Therefore, it is contemplated that any and all such embodiments are included in the present invention as may fall within the literal or equivalent scope of the appended claims.

What is claimed is:

1. A disposable mask for protecting a wearer's face comprising:

a body having an opening sized to cover the nose and mouth of the wearer and a sealed end, the opening defined by edges;

said opening defined by a top edge positioned to extend across the nose and cheeks of the wearer and a bottom edge positioned to extend below the mouth of the wearer;

a fastening system to secure the body to the wearer's face;

said body comprising:

a bond extending circumferentially around said body and positioned between said opening and said sealed end;

a first portion formed from a first material which is shapable around the face, said first portion having a defined width and extending from said opening towards said sealed end to said bond;

a second portion extending from said first portion at said bond to the sealed end of the body, wherein the second portion is formed from a second material different from said first material and which is filtering and gas permeable in both directions; and wherein said first portion is sealed to said second portion along said circumferentially extending bond such that said first portion generally frames said second portion.

2. The disposable mask of claim 1, the body further comprising:

an upper panel of generally trapezoidal configuration joined along three sides to a lower panel of generally trapezoidal configuration;

wherein a fourth longest side of the upper panel forms the top edge of the opening in the body; and wherein a fourth longest side of the lower panel forms the bottom edge of the opening in the body.

3. The disposable mask of claim 2, further comprising radii portions defined in joined sides of said upper and lower panels.

4. The disposable mask of claim 1, wherein said fastening system comprises at least one pair of elongated, flexible members connected to the body.

5. The disposable mask of claim 4, wherein each elongated flexible member is connected to one of the opposite sides of the body.

6. The disposable mask of claim 1, further comprising at least one lateral pleat parallel to the top edge and the bottom edge of the body.

7. The disposable mask of claim 1, wherein the first material is impervious to both gases and liquids.

8. The disposable mask of claim 1, wherein the first portion is comprised of a single layer of material.

9. The disposable mask of claim 1, wherein the first portion further comprises outer layers enclosing an intermediate layer of the first material.

10. The disposable mask of claim 1, wherein the second portion is comprised of a single layer of material.

11. The disposable mask of claim 1, wherein the second portion further comprises outer layers enclosing an intermediate layer of said second material.

12. The disposable mask of claim 1 wherein at least one layer of the first material extends beyond the bottom edge of the body to form a guard operable to cover a portion of the wearer's neck.

13. The disposable mask of claim 1, further comprising an elongated malleable member located in the top edge for conforming the top edge to the contours of said wearer's nose and cheeks.

14. The disposable mask of claim 13, wherein the malleable member is located in the center of the top edge and has a length corresponding to more than 50% and less than 70% of the length of the top edge.

15. The disposable mask of claim 1, wherein the top edge comprises ends opposite each other and the bottom edge comprises ends opposite each other, the ends of the top edge being joined with the ends of the bottom edge to define in part the opening in the body.

16. The disposable mask of claim 1, further comprising side edges connecting the top edge and the bottom edge to define in part the opening in the body.

* * * * *